United States Patent [19]

Mattheck et al.

[11] Patent Number: 4,803,970

[45] Date of Patent: Feb. 14, 1989

[54] MISSILE PROJECTING DEVICE

[75] Inventors: Claus Mattheck, Leimersheim; Siegfried Kremer, Rimbach, both of Fed. Rep. of Germany

[73] Assignee: Kernforschungeszentrum Karlsruhe G.m.b.H., Karlsruhe, Fed. Rep. of Germany

[21] Appl. No.: 58,865

[22] Filed: Jun. 5, 1987

[30] Foreign Application Priority Data

Jul. 5, 1986 [DE] Fed. Rep. of Germany ..... 3622628

[51] Int. Cl.[4] ..... F41B 5/00

[52] U.S. Cl. ..... 124/23 R; 124/16; 403/145

[58] Field of Search ..... 124/23 A, 23 R, 16, 124/26, 27, 24 R, 24 A, 25; 403/120, 145, 149

[56] References Cited

U.S. PATENT DOCUMENTS

| | | | |
|---|---|---|---|
| 428,912 | 5/1890 | Holmes | 124/23 R |
| 1,443,798 | 1/1923 | Mattice | 403/145 X |
| 2,714,377 | 8/1955 | Mulkey | 124/26 X |
| 3,552,373 | 1/1971 | Van Hecke | 124/24 R |
| 3,744,473 | 7/1973 | Nishioka | 124/24 R |
| 3,989,026 | 11/1976 | Nishioka | 124/16 X |
| 4,127,912 | 12/1978 | Deibel et al. | 403/120 X |
| 4,227,509 | 10/1980 | Jones | 124/23 R |

*Primary Examiner*—Randolph A. Reese
*Assistant Examiner*—Anthony Knight

[57] ABSTRACT

In a spring-loaded missile projecting device such as a bow including a center holding part with outwardly projecting support portions having bow members pivotally mounted thereto with a string extending between the free outer ends of the bow members, elbow linkages are arranged between the support portions and the bow members such that the elbows are slightly bent away from the string when the string is straight and the elbow linkages are spring-loaded so as to be forced toward the string for tensioning the string, so as to provide for a relatively large initial string tensioning force which does not appreciably increase by pulling out of the string thereby generating a relatively constant arrow-accelerating force and requiring a relatively low holding force.

2 Claims, 3 Drawing Sheets

MISSILE PROJECTING DEVICE

BACKGROUND OF THE INVENTION

The present invention relates to a spring-loaded missile projecting device such as a bow which has a hand grip disposed at its center with arms extending therefrom and a string extending between the opposite ends of the arms.

Generally, the invention relates to spring-loaded arms which permit the storage of relatively high energy on the basis of forces required to maintain such energy stored and which permit adjustment of the amount of stored energy to the limits given by the physical condition of, for example, a bow's operator.

High energy storage bows, for example, are well known. However, the high retaining forces necessary require large thickness of the spring at the forked ends in order to avoid high material stresses. Also the high bow holding forces must be maintained by the operator during aiming.

It is the object of the present invention to provide spring arms for a high-energy bow wherein the required holding force is relatively low for a given amount of energy stored and also is adjustable and which are highly efficient.

SUMMARY OF THE INVENTION

A spring-loaded missile projecting device such as a bow which includes a center holding part with outwardly projecting support portions on which further outwardly projecting bow members are pivotally mounted with a string extending between the free ends of the outwardly projecting bow members has the bow members resiliently forced outwardly for tensioning the string by elbow linkages which are arranged between the support portions and the bow members and connected thereto at pivot points disposed in a plane spaced from the pivot joint of the bow members toward the string, the elbow linkages being bent away from the string and spring loaded so as to be forced toward the string for forcing the bow portions outwardly and tensioning the string.

The arrangement according to the invention, that is, the elbow linkages in combination with spring means, especially a leaf spring structure, provides for an accurately controllable area of deformation which permits force distribution in a more desirable manner. Especially advantageous is the use of a spring pack providing the desired elasticity for otherwise rigid components which are pivotally joined. Spring breakages or failures are almost certainly impossible. The force required for tensioning the spring can be adjusted to any desired value by adding or removing spring elements. Also the device can easily be disassembled or folded and it is also relatively inexpensive to manufacture.

SHORT DESCRIPTION OF THE DRAWINGS

The invention is described in greater detail on the basis of FIGS. 1 to 4 wherein.

DESCRIPTION OF THE PREFERRED EMBODIMENT

Figure 1:
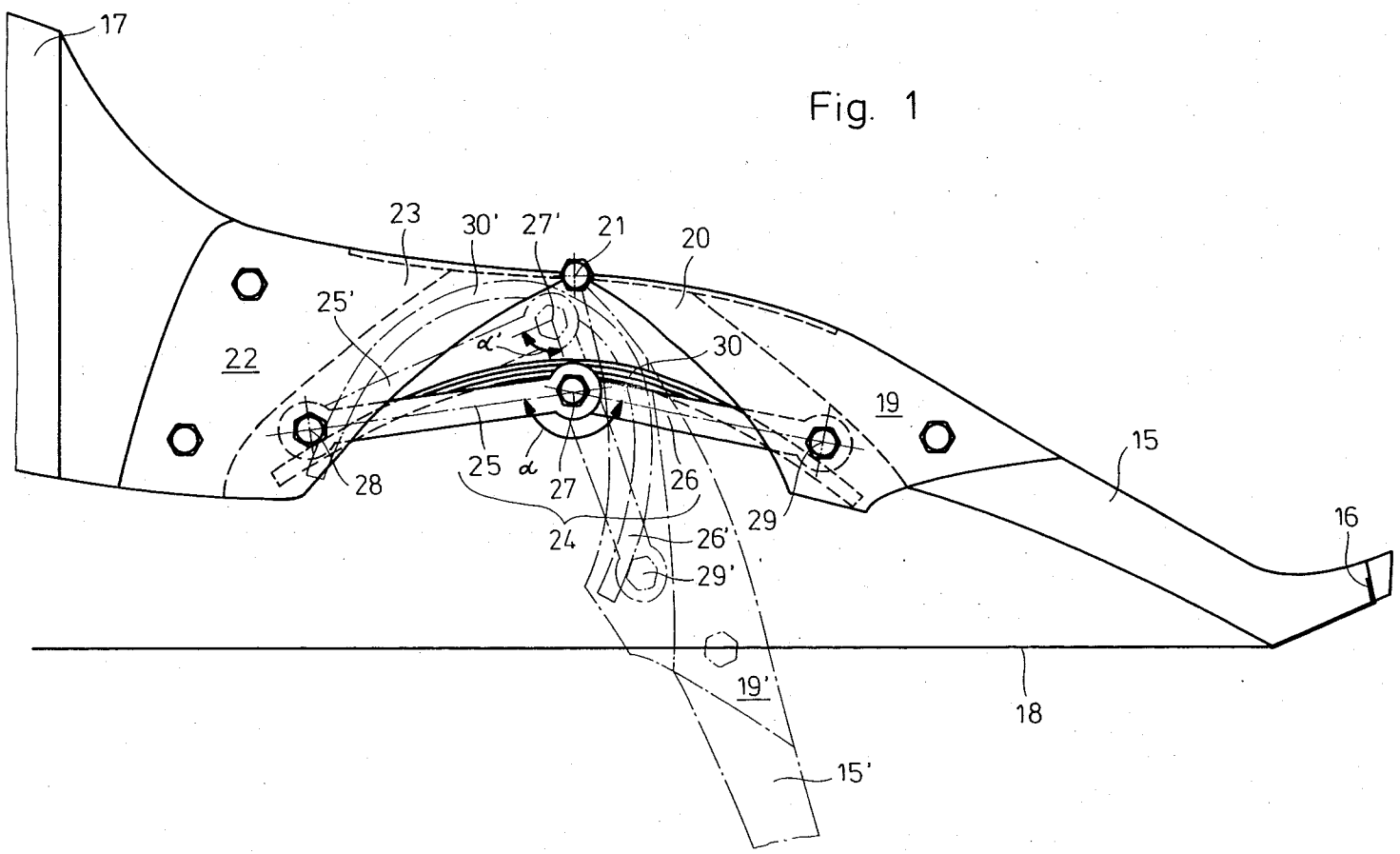
FIG. 1 is a side view of the device, that is, one half of a bow, wherein the position of the components when tensioned is shown in dash-dotted lines.
Figure 2:
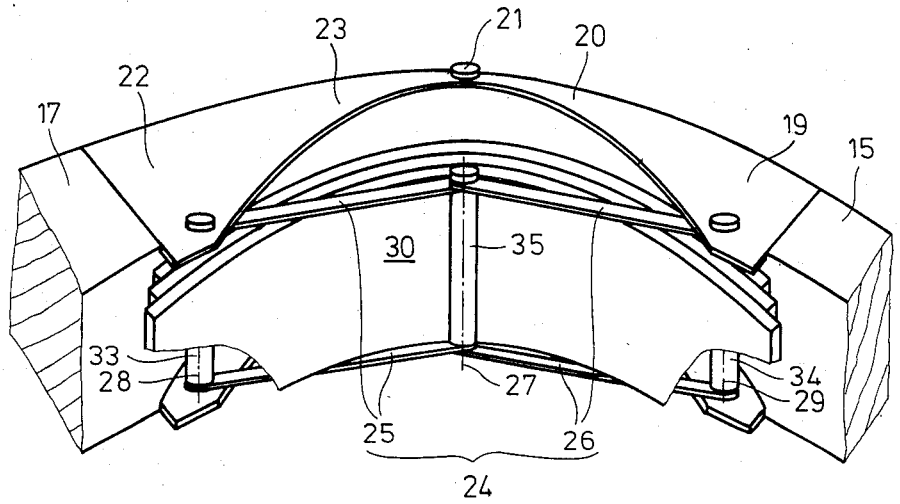
FIG. 2 is a perspective view of the joint area of the device.

FIG. 1 shows one spring arm, that is, one half of a bow, consisting of a central holding part 17 and an outer bow member 15 having an outer string mounting end 16 and an inner bifurcated end joined to the holding part 17 by a pivot joint 21. The pivot joint is formed by prongs 20 which are portions of a first shaped metal member 19 fastened to, and forming part of, the outer bow member 15 as more clearly shown in FIG. 2. The prongs 20 are connected by the joint 21 to the projecting support portions 23 of a second shaped metal member 22 which is mounted to the central holding part 17. The outer bow member 15 with the prongs 20 and the metal member 19 is therefore pivotal relative to the holding part 17 with the metal member 22 and its projections 23. As shown in FIG. 2 the metal members 19 and 22 are provided each with two prongs 20 and projecting support portions 23 for reasons of symmetry and sturdiness and so is the elbow linkage 24 with the elbow joints 27 as described below.

The lower half of the joint area adjacent the string 18 includes the elbow linkage 24 consisting of two arm portions 25 and 26 which are linked together by way of the elbow joint 27 so as to have included an elbow angle $\alpha$, (FIG. 1) which is the angle between the arm portions 25 and 26 adjacent the bow string 18. This angle $\alpha$ is relatively large, that is, the elbow arms are almost stretched in the relaxed bow position so that the elbow joint 27 is disposed at a substantial distance from the bow pivot joint 21 when the linkage is stretched.

With their ends remote from the elbow joint 27 the arm portions 25 and 26 are pivotally mounted to the respective metal members 22 and 19 by means of joints 28 and 29 which both are disposed at a certain distance from the pivot joints 21. The pivot joint 21 is disposed about in the center between the joints 28 and 29 as seen from the string 18. There is provided a package 30 of leaf springs having its center portion disposed adjacent, and in abutment with, the elbow joint 27 on the side thereof facing the pivot joint 21, and its free ends in abutment with the joints 28 and 29 from the opposite sides thereof, such that the elbow joint 27 is resiliently forced toward the string 18. This resiliently forces the members 19 and 22 apart so as to tension the string 18 which however is chosen to be only of such a length that the angle $\alpha$ remains smaller than 180° when the bow is in its relaxed position. As a result it is insured that the elbow is always bent into the proper direction, that is, against the forces of the spring pack 30, when the bow is tensioned.

Figure 3:
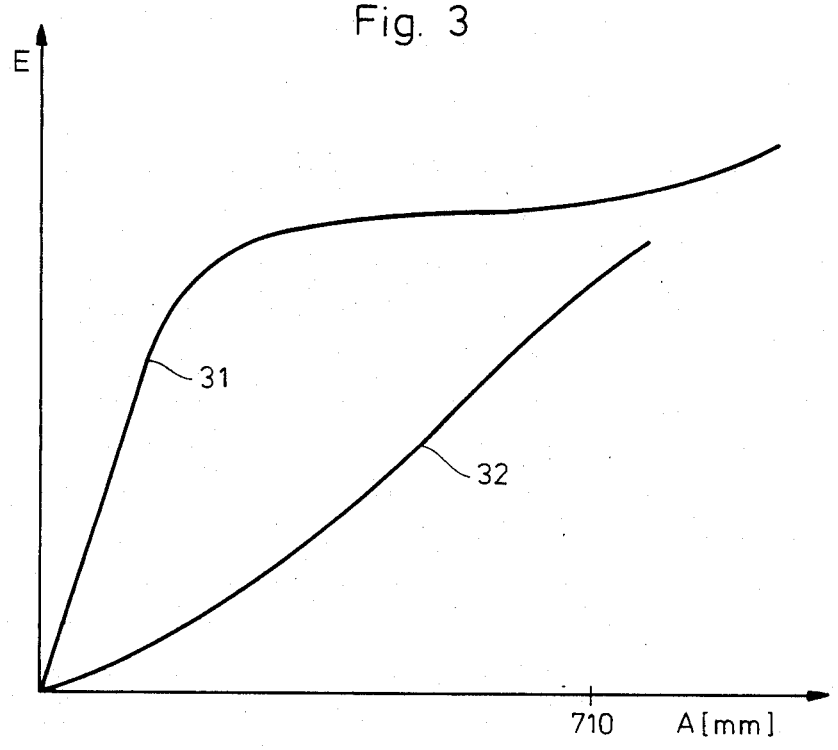
FIG. 3 shows the energy stored by the device when being tensioned in comparison with a conventional bow.
Figure 4:
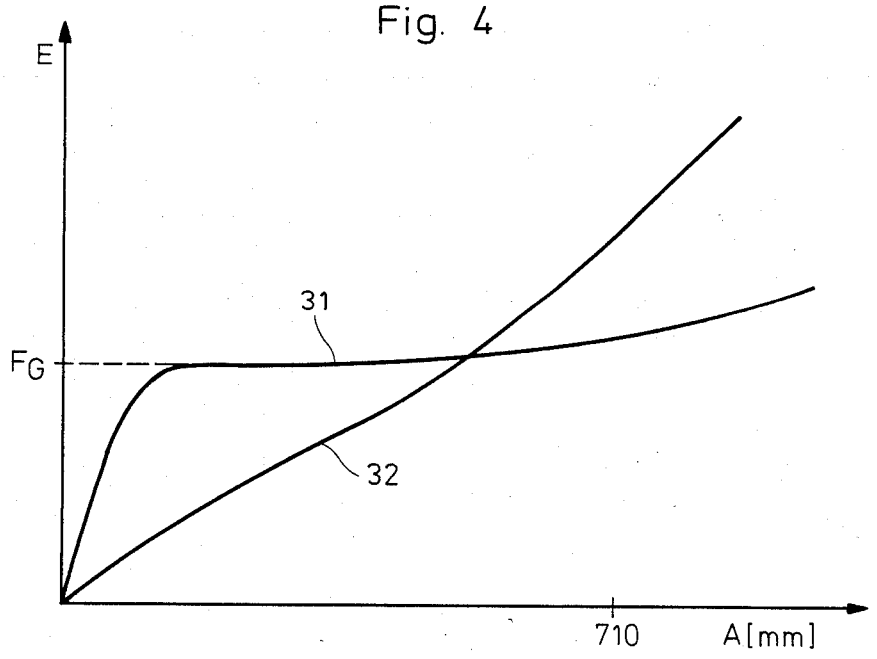
FIG. 4 gives, in a comparison with a conventional bow of the same energy storage capacity, the force applied upon tensioning and the required holding force.

The dash-dotted lines and the indexed numerals of FIG. 1 show the bow in its tensioned state and in FIG. 3 curve 31 shows the force F required for pulling the string of the bow over the pull-out distance A of the string for the bow according to the invention in comparison (curve 32) with a conventional bow (recurve or long bow) both requiring about the same holding force. FIG. 4 shows the same pull-out curves 31, 32, however based on equal amounts of energy stored during the tensioning of the bow. FIG. 4 clearly shows that, at a certain pull-out force FG, the force required for further tensioning is only slightly increasing although the energy stored (the area under line 31) still increases substantially since the force increase is very rapid at the beginning of the string pull-out. As a result the energy transmission from the bow to the arrow, for example, is more even over its bow-accelerated travel distance, that is, the peak force applied to the arrow during energy transfer thereto, is relatively low, thereby reducing possible bending of the arrow. Also the resulting vibration of the arrow shaft is essentially eliminated and furthermore the holding force required for energy storage in the bow is substantially reduced.

In the preferred arrangement as depicted in FIGS. 1 and 2 a spring pack 30 of sandwiched leaf springs is utilized which is properly retained in position. The opposite ends of its leaf springs engage the joints 28 and 29 and slide on the associated connecting bolts 33 and 34. The elbow linkage 24 consists of spaced parallel arms 25, 26 as shown in FIG. 2 which are joined in the elbow joint 27 by way of connecting bolt 35 and in the other joints 28 and 29 by the connecting bolts 33 and 34.

Therefore, also a pair of prongs 20 and projections 23 and the associated joints which are disposed in FIG. 2 behind the spring back 30 are also joined by a bolt but are not visible in FIG. 2. The joints 21, 27, 28 and 29 may therefore be taken as pivot axes. It may also be noted that, in place of the leaf spring pack 30, other types of springs may be utilized.

LISTING OF REFERENCE NUMERALS

15 bow member
16 mounting end
17 holding part
18 string
19 first shaped metal member
20 prong
21 pivot joint
22 second shaped metal member
23 projection
24 elbow linkage
25 linkage arm portion
26 linkage arm portion
27 elbow joint
28 joint
29 joint
30 pack of springs
31 curve
32 curve
33 connecting bolt
34 connecting bolt
35 connecting bolt

What is claimed is:

1. A spring-loaded device for storing energy and releasing such stored energy to a missle, such as an arrow, said device comprising a center holding part with outwardly projecting support portions extending from said center holding part in opposite directions, bow members extending further outwardly from said projecting support portions in opposite directions, with one end of each bow member being pivotally mounted to one of the opposite ends of said support portions, and a string extending between the free other ends of said pivotal bow members, an elbow linkage extending between each of said projecting support portions and the associated bow member, each elbow linkage consisting of arms pivotally joined at one end by an elbow joint and having their other ends connected to said support portions and the associated bow member by arm joints disposed at a location such that a line extending through said joints is spaced from the pivot joints of said bow parts and that pivoting of said bow parts causes bending of said elbow linkage, spring means disposed in engagement with said linkage, said spring means comprising leaf spring means that extend over the full length of said elbow linkage and having a center portion resting on said elbow joint at the side thereof opposite said string and opposite ends resting on said arm joints at the sides thereof facing said string, said leaf spring means being pretensioned so as to resiliently force said linkages toward their stretched positions, said linkages being bent toward the adjacent pivot joints of said bow parts and said string being sufficiently short so as to retain said elbow linkages bent toward said pivot joint such that the elbow linkage angle opposite said string is always smaller than 180° thereby to insure bending of said elbow linkage toward said pivot joints when said bow arms are pivoted by pulling said string.

2. A device according to claim 1, wherein said spring means consists of a plurality of leaf springs so arranged and pretensioned as to provide a force urging said elbow joint toward said string.

* * * * *